US006196887B1

(12) United States Patent
Ogasawara

(10) Patent No.: US 6,196,887 B1
(45) Date of Patent: Mar. 6, 2001

(54) MARINE DRIVE TRANSMISSION

(75) Inventor: Takio Ogasawara, Hamamatsu (JP)

(73) Assignee: Sanshin Kogyo Kabushiki Kaisha, Hamamatsu (JP)

( * ) Notice: Subject to any disclaimer, the term of this patent is extended or adjusted under 35 U.S.C. 154(b) by 0 days.

(21) Appl. No.: 09/285,553

(22) Filed: Apr. 2, 1999

(30) Foreign Application Priority Data

Apr. 3, 1998 (JP) ..... 10-091605

(51) Int. Cl.[7] ..... B63H 23/00
(52) U.S. Cl. ..... 440/75; 74/366
(58) Field of Search ..... 440/75; 74/333, 74/372, 361, 362, 366, 86; 192/41 R

(56) References Cited

U.S. PATENT DOCUMENTS 4,033,282 * 7/1977 Pichl ..... 440/75
4,331,432 * 5/1982 Blanchard ..... 440/75

* cited by examiner

*Primary Examiner*—Jesus D. Sotelo
(74) *Attorney, Agent, or Firm*—Knobbe, Martens, Olson & Bear LLP

(57) ABSTRACT

An improved, low horsepower, compact, high driving power, outboard motor having a reducing transmission located in the upper portion of the driveshaft housing and lower unit so as to provide a larger reduction ratio while maintaining a small lower unit to reduce drag.

8 Claims, 3 Drawing Sheets

MARINE DRIVE TRANSMISSION

BACKGROUND OF THE INVENTION

This invention relates to an outboard motor and more particularly to a reduction drive transmission for an outboard motor.

Relative low horsepower outboard motors are frequently employed as auxiliary power plants for sailboats. By low power, this generally means that the horsepower employed for such applications is something in the neighborhood of 10 horsepower or less. With these low horsepowers, however, the acceleration from standstill to the desired cruising speed can be quite slow. Also, in some instances the engine may not provide sufficient power to achieve the desired speeds.

Although this problem can be somewhat reduced by using a higher reduction ratio in the gear drive from the engine to the propeller, the desire to keep the lower unit, where the transmission resides, small generally limits the reduction ratio in the range of 1.8 to 2.4 to 1. Larger reduction ratios require bevel gears of larger diameters and this will produce a protracted lower unit. As the lower unit size increases, the hydrodynamic drag increases and thus, some of the advantage of the reduced gear ratio will be lost by the increased drag.

It is, therefore, a principal object of this invention to provide an improved marine drive transmission useable with outboard motors to provide a gear reduction greater than the bevel gear of the lower unit and which transmission is located so that it will not increase the size of the lower unit.

It is a further object of this invention to provide an improved reduction gear transmission for outboard motor that does not increase hydrodynamic drag.

SUMMARY OF THE INVENTION

This invention is adapted to be embodied in an outboard motor having a powerhead containing a powering internal combustion engine, a driveshaft housing and lower unit that contain a driveshaft. In the lower unit portion, a bevel gear transmission is provided for driving a propulsion unit driveshaft. A reducing gear transmission is provided in the connection between the engine output shaft and the driveshaft. This transmission is located above the water level when the outboard motor is attached to the transom of an associated watercraft.

DETAILED DESCRIPTION OF THE PREFERRED EMBODIMENT OF THE INVENTION

Figure 1:
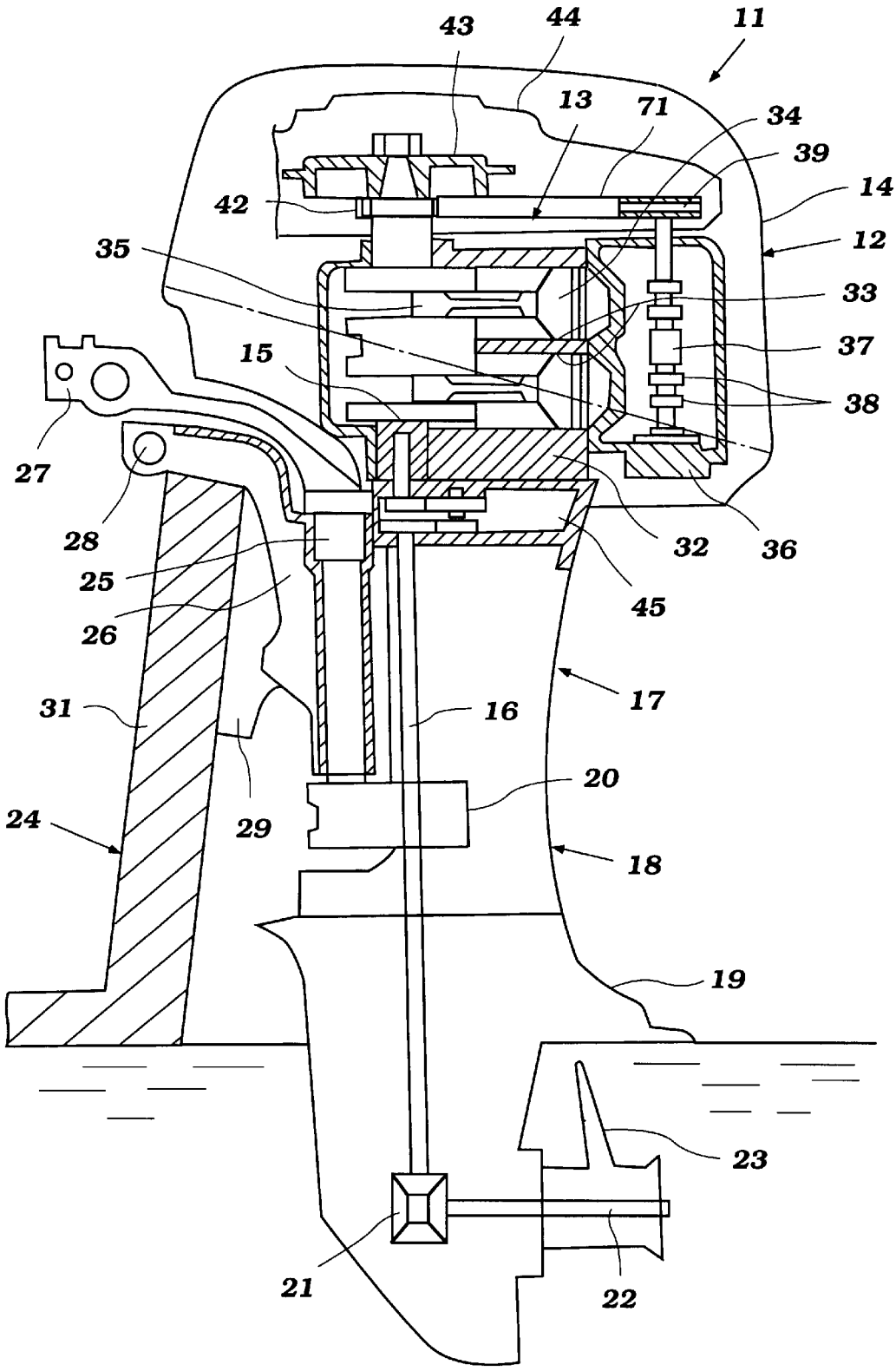
FIG. 1 is a side elevational view of an outboard motor constructed in accordance with an embodiment of the invention, showing the outboard motor attached to the transom of an associated watercraft, which is shown partially and in cross-section, with a portion of the outboard motor broken away so as to more clearly show the construction.
Figure 2:
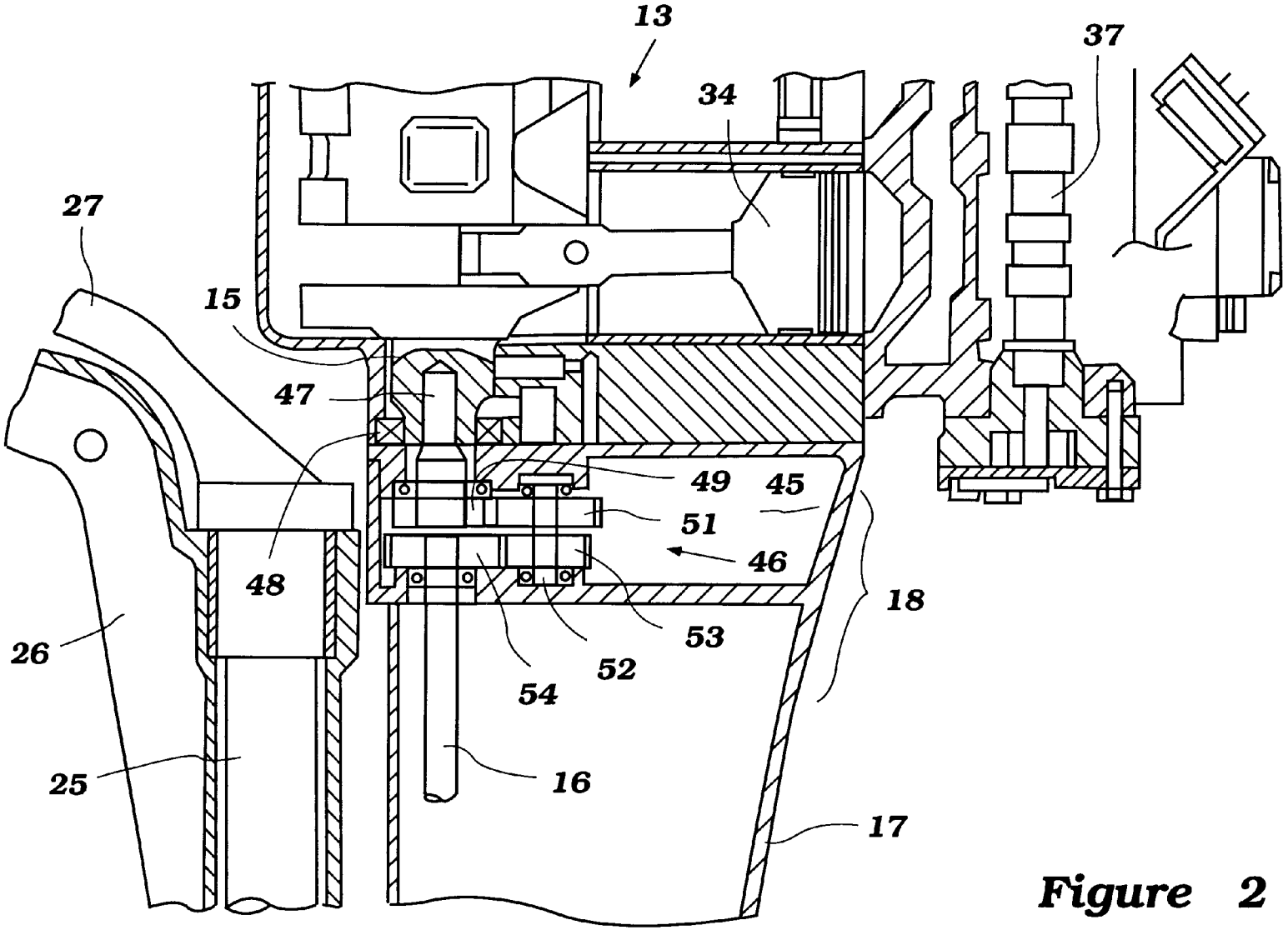
FIG. 2 is an enlarged cross-sectional view looking in the same direction as FIG. 1 and showing the broken away portion of the engine and upper reduction gear transmission.
Figure 3:
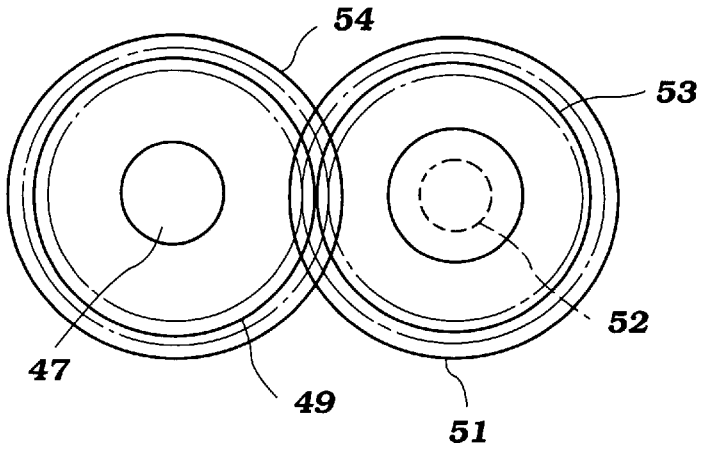
FIG. 3 is an enlarged top plan view of the upper gear reduction transmission.
Figure 4:
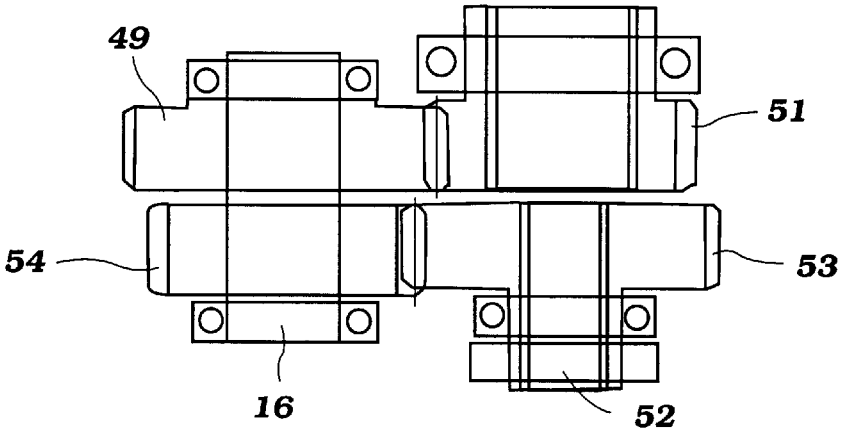
FIG. 4 is a side elevational view of the upper gear reduction transmission.

Referring now in detail to the drawings and initially to FIG. 1, an outboard motor constructed in accordance with an embodiment of the invention is identified generally by the reference numeral 11. The outboard motor 11 includes a powerhead assembly, indicated by the reference numeral 12, which is comprised of a powering internal combustion engine 13 and a surrounding protective cowling 14.

As is typical with outboard motor practice, the engine 13 is positioned within the powerhead 12 so that its crankshaft 15 rotates about a vertically extending axis. This is done so as to facilitate a driving connection with a driveshaft 16 that is journaled for rotation in the driveshaft housing portion 17 of a driveshaft housing and lower unit assembly 18. This assemblage is positioned immediately beneath the powerhead 12.

The driveshaft 16 depends into the lower unit portion 19 of the driveshaft housing lower unit assembly 18 where it drives a conventional bevel gear reducing transmission 21 which may also include a reversing transmission of the type well known in this art. This transmission 21 drives a propeller shaft 22 to which a propeller 23 is affixed for propelling an associated watercraft, shown partially and in cross-section and identified generally by the reference numeral 24.

A steering shaft 25 is affixed to the driveshaft housing and lower unit 18 by means including an attaching bracket 20. This steering shaft 25 is journaled within a swivel bracket 26 for steering of the outboard motor 11 about a generally vertically extending steering axis. A tiller 27 is affixed to the upper end of the steering shaft 26 so as to effect this steering movement.

The swivel bracket 26 is connected by means of a trim tilt pivot pin 28 to a clamping bracket 29. The clamping bracket 29 is, in turn, detachably connected to the transom 31 of the watercraft hull 24 in a suitable manner. Pivotal movement about the pin 28 permits trim and tilt up movement of the outboard motor 11, as is also well known in this art.

The outboard motor 11 is designed primarily to accommodate relatively small horsepower such as 10 horsepower or less. Therefore, the engine 11 is, in the illustrated embodiment, a two cylinder, inline type engine and operates on a four cycle principle.

To this end, the engine is provided with a cylinder block 32 in which a pair of cylinder bores 33 are formed. Pistons 34 reciprocate in these cylinder bores and are connected by connecting rods 35 to the throws of the crankshaft 15 for driving it in a known manner.

A cylinder head assembly, indicated generally by the reference numeral 36, is affixed to the cylinder block 33 in a known manner and contains intake and exhaust valves for admitting and discharging a charge from the combustion chambers formed by the pistons 34, cylinder bores 33 and the lower surface of the cylinder head assembly 36. This mechanism is not shown because it can be of any known type.

However, the engine 13 is of the overhead cam shaft type and therefore includes a cam shaft 37 that is journaled in the cylinder head 36 and which has cam lobes 38 that are associated with these valves for operating them in a manner well known in the art.

The cam shaft 37 has a toothed pulley 39 affixed to its upper end which is driven by a drive belt 41. The drive belt 41 is in turn, driven by a driving pulley 42 that is affixed to the upper end of the crankshaft 15. A flywheel magneto 43 is affixed above this pulley 42.

The cam drive belt 41 and flywheel magneto 43 are covered by a suitable cover 44 within the protective cowling 14.

The construction of the outboard motor as thus far described may be considered to be conventional. For that reason, where any details of the construction are not shown or described, resort may be had by those skilled in the art to known structures for practicing the invention.

In accordance with the invention, an oil pan, indicated by the reference numeral 45 is positioned beneath the cylinder block 31 and in the upper portion of the driveshaft housing lower unit 18. Contained within this oil pan 41 is oil for lubricating the engine 13 through a suitable lubricating system which is not shown.

However, and in accordance with the invention, a reduction gear transmission, indicated generally by the reference numeral 46, is also positioned within this oil pan 45 for not only coupling the crankshaft 15 to the driveshaft 16 but also providing a step down transmission so that the transmission ratio between the crankshaft 35 and the propeller shaft 22 can be made lower than with prior art constructions without increasing the size of the bevel gears of the bevel gear reversing transmission 21.

This reducing transmission 46 includes an input drive shaft 47 that has a spline connection to the crankshaft 15. This shaft 47 extends through an oil seal 48 and has a first gear 49 either affixed for rotation with it or formed integrally with it. This gear 49 is enmeshed with a larger driven gear 51 of the transmission 46 so as to provide a first step down in transmission ratio.

The first driven gear is fixed for rotation with a shaft 52 that is journaled in a pair of space bearings formed in the upper and lower surfaces of the oil pan 45. A second driving gear 53 is fixed for rotation with the driven shaft 52 and drives a larger diameter driven gear 54 that is affixed to the upper end of the driveshaft 16 so as to provide a second step down in the transmission ratio.

Thus, by employing a transmission with two step downs it is possible to make the transmission smaller than if the reduction were made in a single set of gears. Also, this permits the drive shaft 16 to maintained in the alignment with the crankshaft 15 so that the transmission 46 can be an option to an outboard motor without changing anything other than either adding or subtracting. Also, since the shafts are all maintained in a parallel relationship, machining and assembly is simplified.

Figure 5:
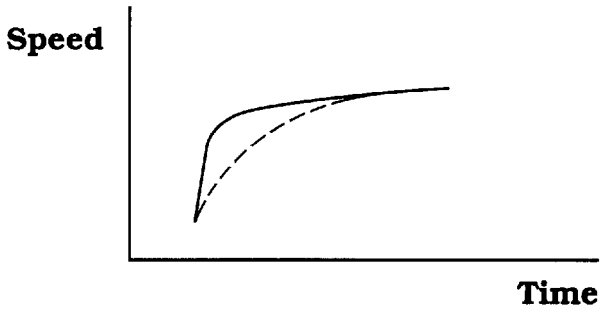
FIG. 5 is a graphical view showing how the performance of the watercraft propelled by the outboard motor incorporating the invention is improved over a conventional arrangement.

FIG. 5 shows the results of utilizing this upper reducing transmission 46. The broken line curve of this figure shows the acceleration of a watercraft powered by an outboard motor of the same horsepower but lacking the reducing transmission 46. The solid line curve shows the improved acceleration achieved through the use of the reducing gear 46.

Thus, from the foregoing description it should be readily apparent that the described construction provides a very effective low horsepower but high driving power outboard motor that can be used as an auxiliary transmission for sailing watercraft or which can be used for conventional watercraft. Of course, the foregoing description is that of a preferred embodiment of the invention and various changes and modifications can be made without departing from the spirit and scope of the invention, as defined by the appended claims.

What is claimed is:

1. An outboard motor having a power head containing a powering internal combustion engine having an output shaft, a drive shaft housing and lower unit depending from said power head, a drive shaft journalled in said drive shaft housing and lower unit, a bevel gear transmission in said lower unit for driving a propulsion unit, and a reducing gear transmission provided in the connection between said engine output shaft and said drive shaft for driving said drive shaft at fixed speed ratio below that of said engine output shaft, said reducing gear transmission being located above the water level when said outboard motor is attached to the transom of an associated watercraft.

2. An outboard motor as set forth in claim 1, wherein the reducing gear transmission is provided at the upper end of the driveshaft housing and lower unit.

3. An outboard motor as set forth in claim 1, wherein the reducing gear transmission includes a first step down transmission driven from the engine output shaft and a second step down transmission driven from said first step down transmission and driving the driveshaft.

4. An outboard motor as set forth in claim 3, wherein the driven gear of the first step down transmission and the driving gear of the second step down transmission are affixed to a common shaft that is parallel to the engine output shaft and the drive shaft.

5. An outboard motor as set forth in claim 4, wherein the axes of the engine output shaft and driveshaft are aligned.

6. An outboard motor as set forth in claim 5, wherein the reducing gear transmission is provided at the upper end of the driveshaft housing and lower unit.

7. An outboard motor as set forth in claim 6, wherein the reducing gear transmission is contained within an oil reservoir for the internal combustion engine of the powerhead.

8. An outboard motor having a power head containing a powering internal combustion engine having an output shaft, a drive shaft housing and lower unit depending from said power head, a drive shaft journalled in said drive shaft housing and lower unit, a bevel gear transmission in said lower unit for driving a propulsion unit, an oil reservoir for said internal combustion engine provided at the upper end of said drive shaft housing and lower unit and a reducing gear transmission contained within said oil reservoir said reducing gear transmission being provided in the connection between said engine output shaft and said drive shaft and being located above the water level when said outboard motor is attached to the transom of an associated watercraft.

* * * * *